United States Patent [19]

Uchida et al.

[11] Patent Number: 5,067,938

[45] Date of Patent: Nov. 26, 1991

[54] CENTRIFUGAL SEPARATOR

[75] Inventors: Tadahiro Uchida, Sayama; Kuniyuki Shimamura, Niiza; Hayabu Nogawa, Tokyo; Keikichi Saito, Kawagoe; Minoru Hara, Sakado, all of Japan

[73] Assignee: Kabushiki Kaisha Kubota Seisakusho, Tokyo, Japan

[21] Appl. No.: 170,962

[22] Filed: Mar. 18, 1988

[30] Foreign Application Priority Data

Mar. 20, 1987 [JP] Japan ..... 62-41330[U]
Mar. 23, 1987 [JP] Japan ..... 62-43357[U]
Mar. 25, 1987 [JP] Japan ..... 62-44831[U]

[51] Int. Cl.[5] ..... B04B 7/06

[52] U.S. Cl. ..... 494/12; 494/85; 494/10; 68/3 R; 312/327

[58] Field of Search ..... 494/10, 11, 12, 60, 494/85, 16, 84, 34, 31; 220/315, 316; 68/3 R, 23 R; 292/50, 255, DIG. 69; 73/866.1; 340/521; 312/327, 321.5, 323, 326, 328, 327

[56] References Cited

U.S. PATENT DOCUMENTS 2,416,276 2/1947 Ruge ..... 73/866.1 X
3,244,363 4/1966 Hein ..... 494/16 X
3,520,568 7/1970 White ..... 292/255
3,601,434 8/1971 Fargo ..... 292/50
3,683,652 8/1972 Halopoff et al. ..... 292/50 X
4,244,513 1/1981 Fayer et al. ..... 494/10
4,307,374 12/1981 Bode et al. ..... 340/521
4,464,161 8/1984 Uchida et al. ..... 494/16 X

FOREIGN PATENT DOCUMENTS 75097 4/1985 Japan ..... 68/3 R

*Primary Examiner*—Frankie L. Stinson
*Attorney, Agent, or Firm*—Pollock, Vande Sande & Priddy

[57] ABSTRACT

In a centrifugal separator which has in the top panel of its case an opening communicating with a rotor chamber and a control panel disposed behind the opening, a lid for covering the opening has a cutaway made in its lower portion for receiving the control panel and the pivot of the lid is extended laterally to the rear of the control panel. The lid is spring biased toward its open position and is opened by depression of a foot pedal that is connected to a lid lock mechanism. The control panel includes an indicator of rotor rotational frequency and rotor chamber temperature, the indicator being supplied with electrical signals produced by sensors within the case of the centrifugal separator.

12 Claims, 6 Drawing Sheets

CENTRIFUGAL SEPARATOR

BACKGROUND OF THE INVENTION

The present invention relates to a centrifugal separator for centrifugal separation or precipitation of substances in fluid samples.

A conventional centrifugal separator has an opening 2 in the top of its case 1, in which is provided a rotor compartment 3 communicating with the opening 2, as shown in FIG. 1. A rotor (not shown) is rotatably disposed in the rotor chamber 3 and driven by a motor (not shown) for centrifuging samples mounted on the rotor.

A control panel 4 is disposed on the top of the case 1 behind the opening 2. On the control panel 4 there are provided instruments for setting the rotor driving speed and time, a power switch, a speed indicator and, if necessary, an instrument for setting temperature in the rotor chamber 3. A lid 5 is hingedly fixed to the top of the case 1 at one side thereof and opens sideways.

With the lid 5 open, the conventional centrifugal separator consumes more space in the lateral direction. Where several such centrifugal separators are arranged sideways, if one of them is left with its lid open, the adjoining separator is not easily accessible. Even if only one separator is used, the lid standing aslant at one side of the opening may sometimes hinder work of mounting buckets (for attaching sample containers to the rotor) on or dismounting them from the rotor. For example, when taking out centrifuged samples from the rotor chamber, the buckets may be inadvertently bumped against the lid, spilling the samples or re-mixing them. Therefore, it is preferable that the lid be open in front rather than sideways.

Conventionally, a centrifugal separator of the type where the lid is open in front is such as shown in FIG. 2, in which the lid 5 is pivotally mounted on the top of the case 1 rear of the opening 2, i.e. in front of the control panel 4. In this instance, since the front of the control panel 4 is hidden by the lid 5 when it is open, there is a risk of power being left ON after use of the centrifugal separator. Furthermore, since the lid 5 is mounted on the case 1 between the opening 2 and the control panel 4, the latter stands well back from the front of the separator, and hence is rather difficult to manipulate.

There has also been proposed a centrifugal separator of the type in which the lid 5 is open in front and the control panel 4 is disposed in front of the opening 2. In this case, the control panel 4 is easy to manipulate, but there is the possibility that when taking samples in or out of the rotor chamber the samples may be spilled from the bucket over the control panel 4, causing an electrical failure. Moreover, since the opening 2 is positioned behind the control panel 4, difficulty is encountered not only in mounting the rotor on and dismounting it from the motor shaft in the rotor chamber but also in mounting sample buckets on and dismounting them from the rotor.

For safety operation the centrifugal separator is usually designed so that when the lid is closed, it is locked and cannot be opened unless unlocked.

A conventional lid unlock mechanism of this kind has an operating knob projecting out of a recess made in one side of the separator case. By pressing the operating knob, an actuating plate is moved for unlocking the lid.

With such an arrangement, however, an operator is required to open the lid with one hand while unlocking it by pressing the operating knob with the other hand, after once putting samples on a table nearby. Accordingly, mounting of the samples on the rotor is very cumbersome and time-consuming in the prior art.

Furthermore, the conventional centrifugal separator has a speed indicator 6 and a temperature indicator 7 separately provided as shown in FIGS. 1 and 2, and hence has a disadvantage that the control panel 4 is inevitably large.

It is therefore an object of the present invention to provide a centrifugal separator which has a lid open in front, allows ease in manipulating the control panel and obviates the defect of the control panel being hidden by the lid when the lid is open.

Another object of the present invention is to provide a centrifugal separator which enables an operator to unlock the lid even if he holds samples with both hands and automatically opens the lid upon unlocking.

Yet another object of the present invention is to provide a centrifugal separator which permits miniaturization of the control panel.

SUMMARY OF THE INVENTION

According to an aspect of the present invention, the lid has in its lower portion a cutaway shaped to receive the control panel and the pivot of the lid is provided laterally well back from the front of the control panel.

That is, the lid is open in front and its pivot is positioned behind the front of the control panel. Since the lid has the cutaway in its lower portion, the control panel does not hinder opening and closing of the lid. When the lid is open, the front of the control panel stands in front of the cutaway, and hence is not hidden by the lid. Accordingly, there is no risk of power being inadvertently left ON. Since the control panel is positioned further to the front than in the prior art, operability of the centrifugal separator of the present invention is excellent.

According to another aspect of the present invention, a pedal is provided on the underside of the case and, its vertical motion is transmitted by a transmission mechanism to the position of an operating plate and is changed by a motion changing mechanism to a lateral motion of the operating plate. In this instance, the vertical motion of the pedal resulting from stepping it on causes the operating plate to disengage lock means from a hook of the lid, i.e. to unlock the lid. The lid is biased by biasing means in a direction in which to open.

Simply by stepping on the pedal the lid is unlocked and automatically opened by the biasing force of the biasing means. Accordingly, an operator can install samples on the rotor easily and rapidly without the need of putting the samples on a nearby table before opening the lid.

According to yet another aspect of the present invention, the rotational frequency of the rotor is detected by a rotary sensor as an electric signal. The temperature of the rotor chamber is detected by a temperature sensor as an electric signal. The electric signals from the rotary sensor and the temperature sensor are selectively led out through use of a change-over switch and the selected signal is supplied to an indicator. A level adjuster is connected between the change-over switch and at least one of the rotary sensor and the temperature sensor. Whether the electric signal to the indicator is the output from the rotary sensor or temperature sensor, its level is adjusted for providing a suitable indication.

DESCRIPTION OF THE PREFERRED EMBODIMENTS

Figure 1:
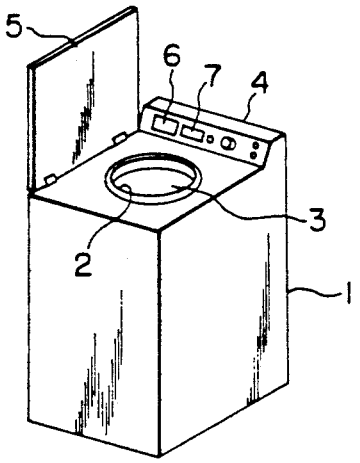
FIG. 1 PRIOR ART
FIG. 1 is a perspective view of a conventional centrifugal separator.
Figure 2:
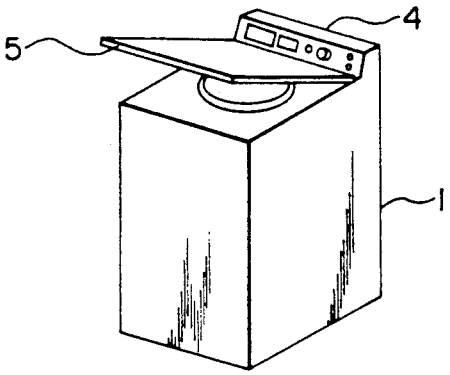
FIG. 2 PRIOR ART
FIG. 2 is a perspective view showing another conventional centrifugal separator.
Figure 3:
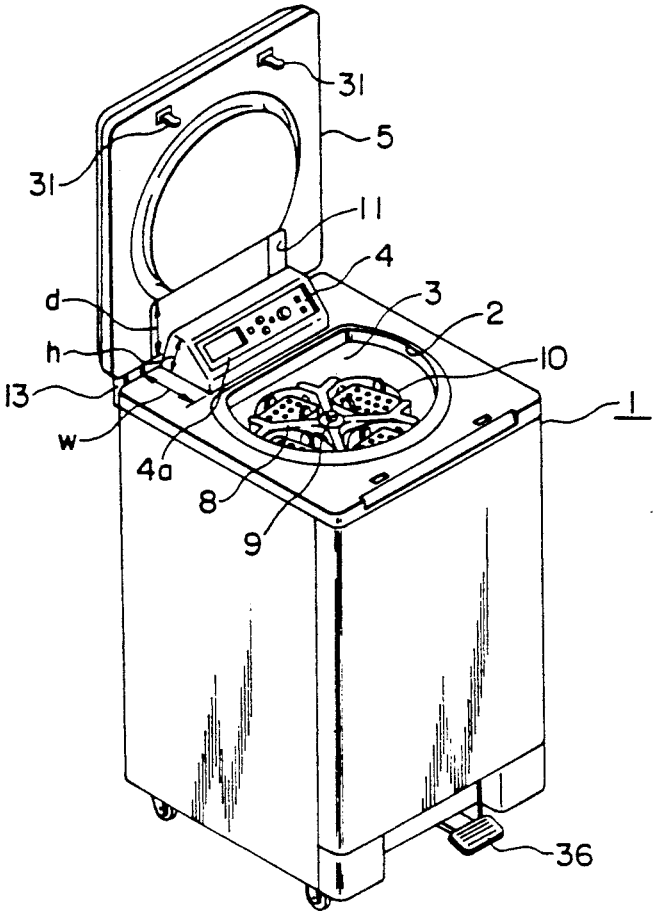
FIG. 3 is a perspective view illustrating an example of the centrifugal separator of the present invention.
Figure 4:
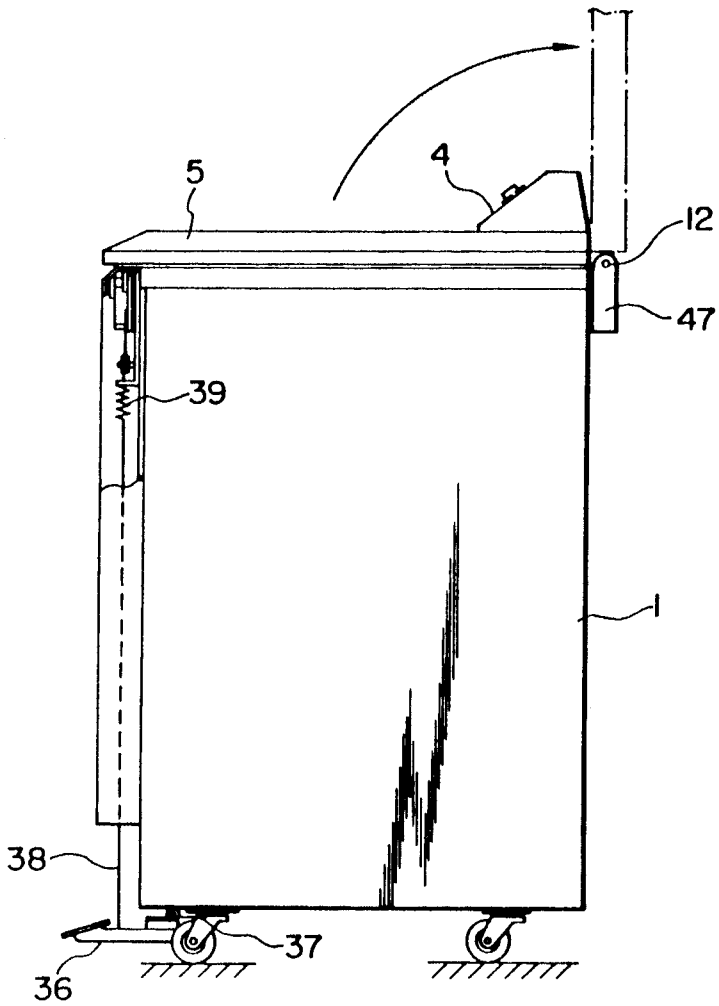
FIG. 4 is a side view of the centrifugal separator of the present invention.

FIGS. 3 and 4 illustrate an embodiment of the present invention, in which the parts corresponding to those in FIG. 1 are identified by the same reference numerals. In FIG. 3, a rotor 8 is mounted on a motor shaft 9 in the rotor chamber 3 and buckets 10 are suspended from the rotor 8. In this example the opening 2 is not round but its rear portion is straight so that the control panel 4 is positioned to the front accordingly.

The lid 5 can be open in front and has a rectangular cutaway 11 in its base portion along which the lid 5 is hingedly fixed to the case 1. A pivot 12 (FIG. 4) of the lid 5 extends laterally in rear of the control panel 4. In the illustrated example hinges 13 are mounted at the top of the rear panel of the case 1 on either side of the control panel 4 and the axes of the hinges 13 are adjacent the rear edge of the top panel of the case 1. The lid 5 is mounted on the hinges 13. The depth d of the cutaway 11 is so selected that the control panel 4 will not hinder opening and closing of the lid 5; namely the depth d is larger than the height h and the width w of the control panel 4. Furthermore, the lid 5 and the control panel 4 are positioned so that at least the front 4*a* of the latter may lie forwardly of the cutaway 11 when the lid 5 is open.

With such a structure as mentioned above, since the front 4*a* of the control panel 4 is not hidden by the lid 5 when it is open, there is no risk of inadvertently leaving power ON. Moreover, since the pivot 12 of the lid 5 is disposed behind the front 4*a* of the control panel 4, that is, since the panel 4 lies near the opening 5, manipulation of the control panel 4 is easy.

In addition, since the control panel 4 is positioned behind the opening 2, the rotor 8 and the buckets 10 can easily be put in and out of the rotor chamber 3. This will eliminate the possibility of spilling samples over the control panel 4 which could lead to an electrical failure. Moreover, even if a plurality of centrifugal separators are arranged side by side, the adjoining separators can easily be accessed because each lid is open in front. In other words, the centrifugal separator of the present invention occupies less space in the lateral direction.

Next, a description will be given of the lid unlocking mechanism according to the present invention.

Figure 6:
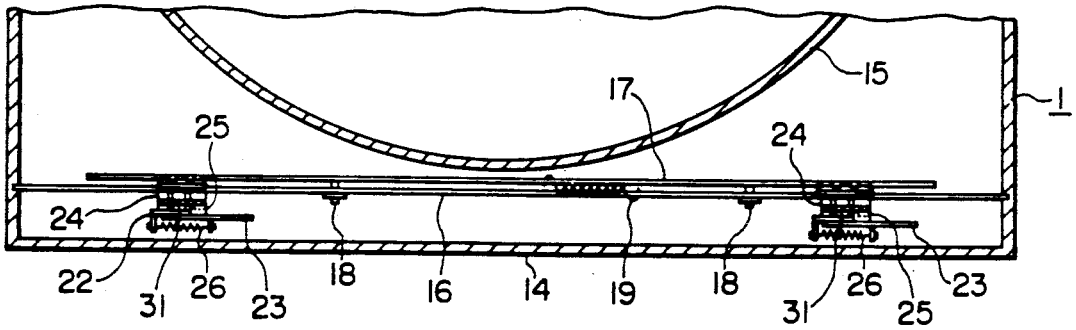
FIG. 6 is a sectional view taken on the line I—I in FIG. 5, showing a lid lock mechanism.

As shown in FIG. 6, a lid locking mechanism is provided between the front panel 14 of the case 1 and a rotor container 15. In the rotor container 15 a rotor (not shown) is disposed and is driven by a motor (not shown).

Figure 7:
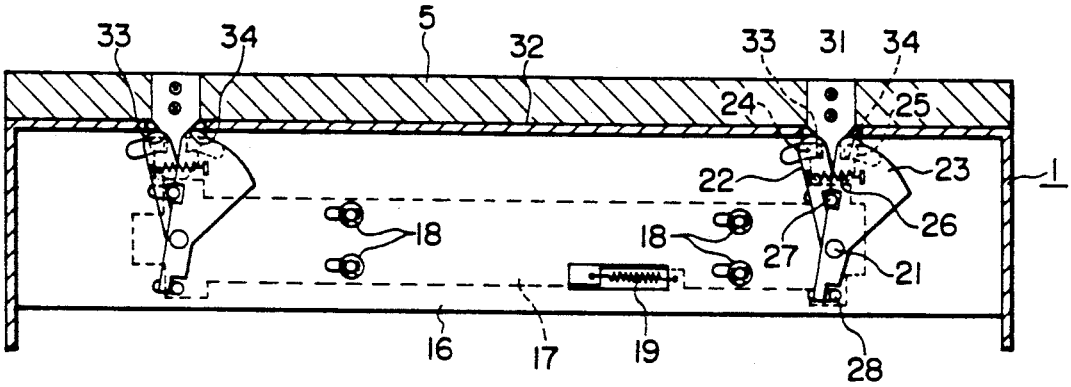
FIG. 7 is a front view showing the locking state of the lid lock mechanism.

In the lid locking mechanism a base plate 16 is mounted on the case 1 opposite the front panel 14. On the base plate 16 an operating plate 17 is mounted by pins 18 opposite thereto in a manner to reciprocate from side to side, as shown in FIGS. 6 and 7. The operating plate 17 is biased by a coiled spring 19 to the right in FIGS. 6 and 7.

A pair of lock plates 22 and 23 are mounted on the base plate 16 in a manner to be rotatable about a shaft 21. The lock plates 22 and 23 have lock portions 24 and 25 protrusively provided on their end portions, respectively. The lock plates 22 and 23 are biased by a coiled spring 26 about the shaft 21 so that their lock portions 24 and 25 approach each other. A pair of drive pins 27 and 28 planted on the operating plate 17 project out of the base plate 14 on the side opposite from the shaft 21 and they are in contact with or adjacent the lock plates 22 and 23 on the left-hand marginal edges thereof in FIG. 7.

Figure 8:
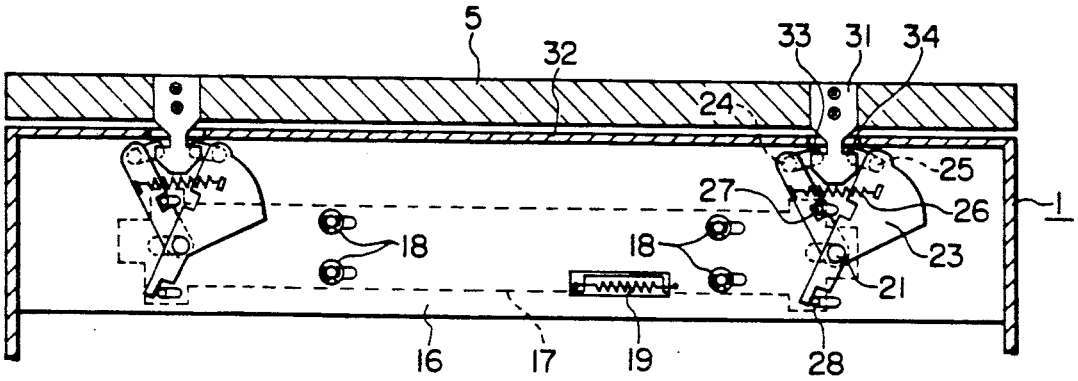
FIG. 8 is a front view showing the unlocking state of the lid lock mechanism.

Accordingly, when the operating plate 17 is moved to left in FIG. 7 against the biasing force of the coiled spring 19, the drive pins 27 and 28 engage the lock plates 22 and 23, respectively, by which the lock plates 22 and 23 are turned about the shaft 21 counterclockwise and clockwise, respectively, spacing the lock portions 24 and 25 wide apart, as depicted in FIG. 8.

The lid 5 has a hook 31 projecting downward therefrom. As the lid 5 is closed, the hook 31 is inserted into the case 1 through a slot made in an upper panel 32 of the case 1 and engaged at its end portion with the lock portions 24 and 25, pushing them aside against the biasing force of the coiled spring 26. As the lid 5 is further pressed down, the lock portions 24 and 25 snap into engaging recesses 33 and 34 of the hook 31, respectively, locking the lid 5 as shown in FIG. 7. As will be seen from the above, the lid 5 can be unlocked simply by moving the operating plate 17 to the left-hand side in FIG. 7 to disengage the lock portions 24 and 25 from the hook 31 as shown in FIG. 8.

Figure 5:
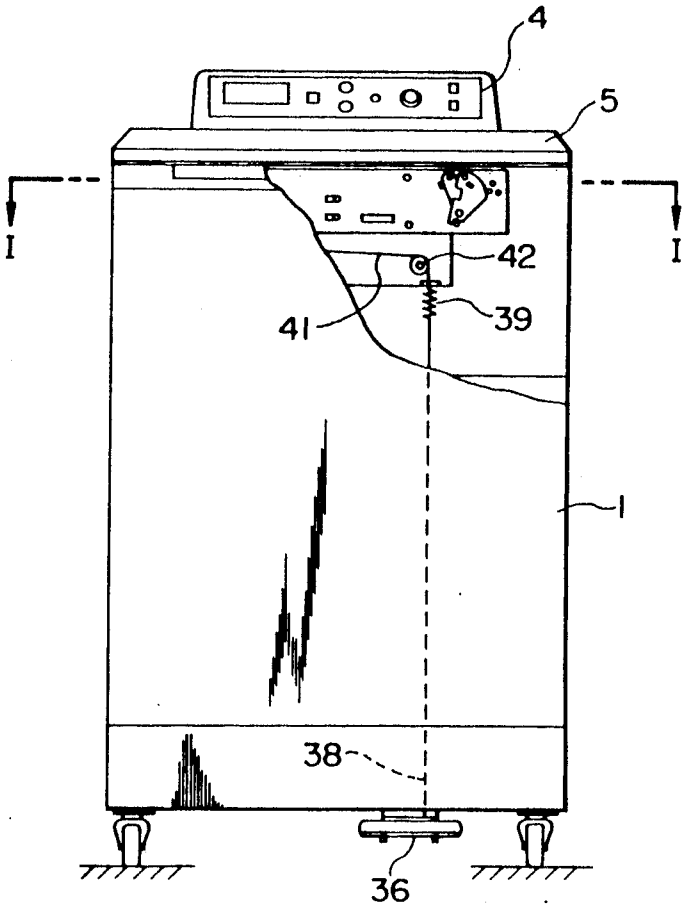
FIG. 5 is a front view, partly cut away, of the centrifugal separator of the present invention.
Figure 9:
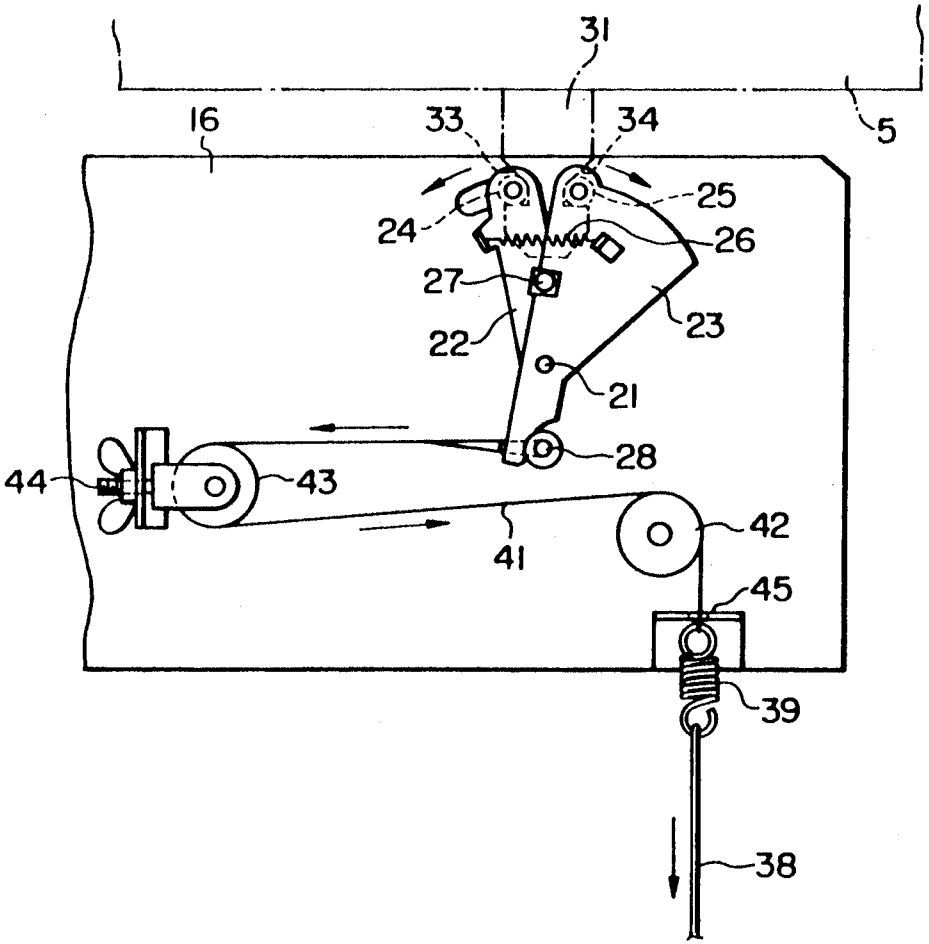
FIG. 9 is a front view showing an example of a motion changing mechanism.

According to the present invention, provision is made for unlocking the lid 5 by stepping on a pedal. As shown in FIGS. 4 and 5, a pedal 36 is provided under the case. The pedal 36 is pivotally secured at one end to the forward portion of the bottom panel of the case 1 by means of a hinge 37. A wire 38 is fixed at one end to the pedal 36 and at the other end to one end of a coiled spring 39, the other end of which is coupled to one end of a wire 41, as shown in FIG. 9. Pulleys 42 and 43 are rotatably mounted on the base plate 16, and they are arranged in the lateral direction in FIG. 9. The wire 41 is threaded over the right-hand pulley 42 and around the left-hand pulley 43 and is fixed at its other end to the drive pin 28.

The pulley 43 is so arranged that its position on the base plate 16 can be shifted laterally relative thereto by means of a screw 44. The tension of the wire 41 can therefore be adjusted by suitably positioning the pulley 43. The operating plate 17 is biased by the coiled spring 19 (FIG. 7) to the left-hand side in FIG. 7, then the drive pin 28 is also biased rightward accordingly, and the wire 41 is pulled in the direction reverse from that indicated by arrows in FIG. 9, with the result that the pedal 36 is pulled up through the wire 38. A stopper 45 is provided above the coiled spring 39 to limit the pulling-up of the pedal 36, holding it at a fixed position at all times.

With such an arrangement, when the pedal 36 is stepped on, its vertical motion is transmitted by the wire 38 to the vicinity of the operating plate 17. Upon pulling-down of the wire 38, the wire 41 is pulled as indicated by the arrows in FIG. 9, by which the drive pin 28 is moved to the left in FIG. 9 and the operating plate 17 is also pulled to the left; namely, the vertical motion of the pedal 36 is changed to the horizontal motion of the operating plate 17. As the operating plate 17 is shifted to the left, the lock plates 22 and 21 are turned by the drive pins 27 and 28 in opposite directions, by which the lock portions 24 and 25 are disengaged from the recesses 33 and 34 of the hook 31, as shown in FIG. 8. Thus the lid 5 is unlocked.

On the other hand, the lid 5 is pivotally secured by a spring hinge 47 to the upper edge of the rear panel of the case 1 as depicted in FIG. 4, and upon unlocking the lid 5 as described above, the lid is automatically opened by the spring force of the spring hinge 47 as indicated by the one-dot chain line.

Figure 10:
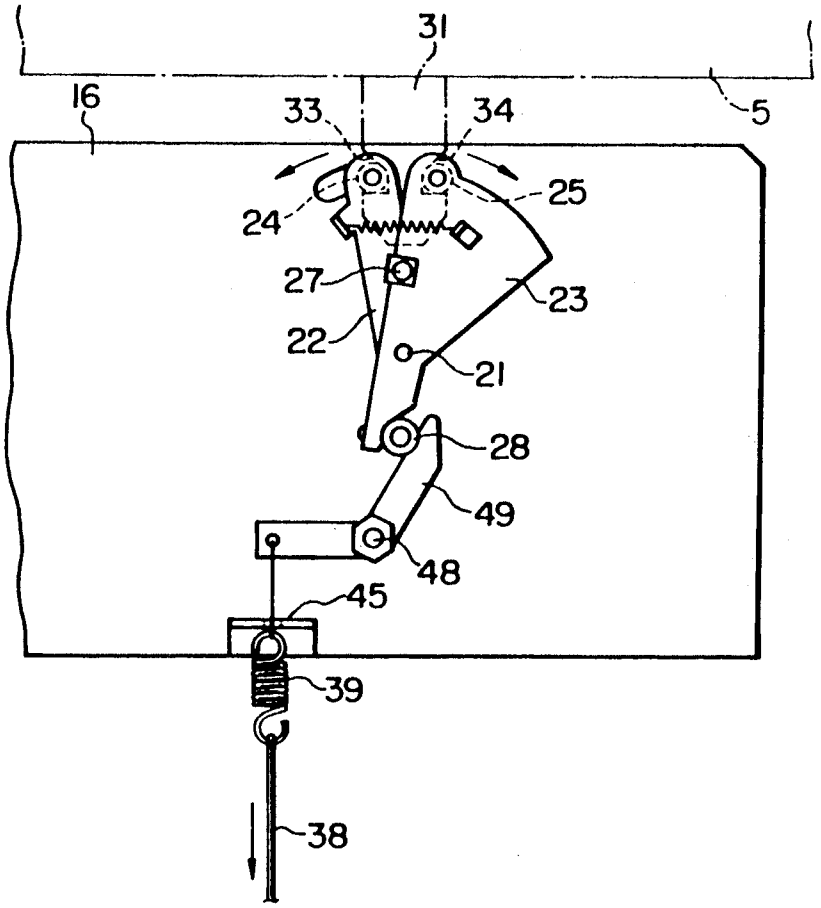
FIG. 10 is a front view showing another example of the motion changing mechanism.

FIG. 10 illustrates another example of the arrangement for changing the vertical motion of the pedal 36 to the horizontal motion of the operating plate 17. Instead of using the wire 41 and the pulleys 42 and 43, a cam 49 is mounted on the base plate 16 in a manner to be rotatable about a shaft 48 and the cam 49 is fixed at one end to one end of the coiled spring 39 and at its other end is engaged with the drive pin 28. When the pedal 36 is stepped on, the cam 49 turns counterclockwise in FIG. 10, by which the drive pin 28 is driven to the left in FIG. 10 and the lock portions 33 and 34 are moved out of engagement with the hook 31, automatically opening the lid 5.

In the case where the pedal 36 is stepped on strongly and the amount of its downward movement is relatively large owing to a particular condition of the place where the centrifugal separator is installed, the drive pins 27 and 28 move as far as possible to their extreme positions and then the coiled spring 39 slacks back. Accordingly, there is no fear of the lock mechanism being broken down.

As described above, according to the present invention, when an operator steps on the pedal 36, the lid 5 automatically opens, so that he can immediately install samples on the rotor without the necessity of putting them on a table nearby. That is, samples can be put on the rotor easily and rapidly.

Next, a description will be given of the centrifugal separator of the present invention which has a control panel designed for providing a rotational frequency indication and a temperature indication on a single indicator.

Figure 11:
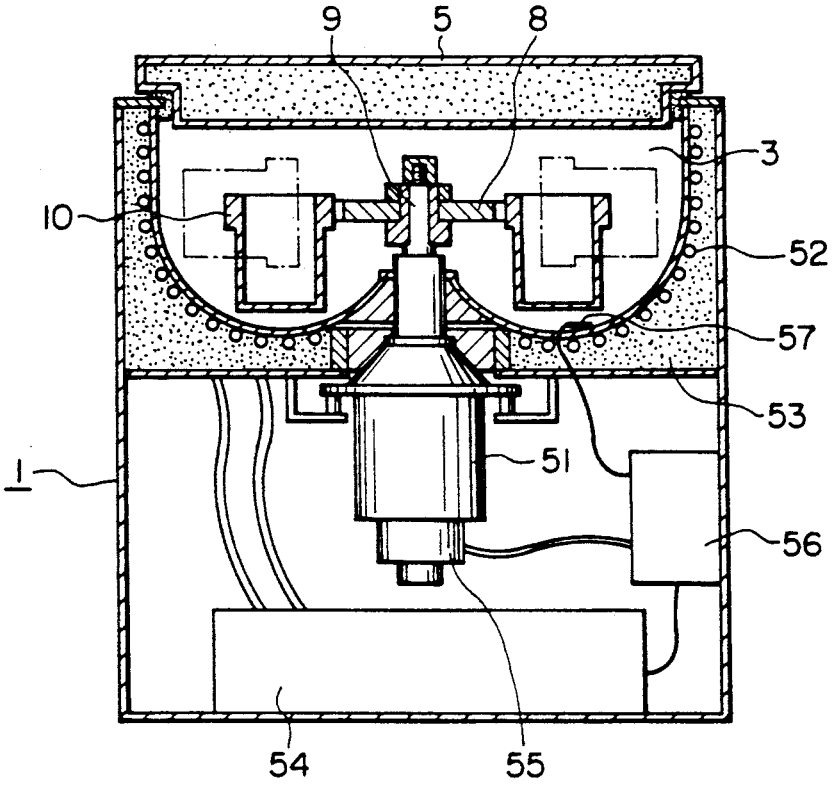
FIG. 11 is a sectional view illustrating another example of the centrifugal separator of the present invention.

FIG. 11 illustrates a cooling type centrifugal separator embodying the present invention. In FIG. 11 the parts corresponding to those in FIG. 3 are identified by the same reference numerals. In the rotor chamber 3 the rotor 8 supporting the buckets 10 is disposed on the motor shaft 9. The motor shaft 9 projects out of a motor 51 disposed under the rotor chamber 3. The rotor chamber 3 is covered with cooling pipes 52 disposed all over its outer peripheral surface and a heat insulating layer 53 is provided outside of the cooling pipes 52. A freezing machine 54 is disposed on the bottom panel of the case 1 and a liquid cooled by the freezing machine 54 is circulated through the cooling pipes 52, cooling the rotor chamber 3.

A tachogenerator which is driven by the motor shaft 9 is disposed as a rotary sensor 55, which provides an electric signal of a voltage corresponding to the revolving speed of the rotor 8 and supplies the signal to a control circuit 56. In the rotor chamber 8 a temperature sensor 57 is disposed. A resistance element which varies its resistance value with temperature, such as a platinum resistance element, can be employed as the temperature sensor 57. The temperature sensor 57 is also connected to the control circuit 56 and provides an electric signal of a voltage corresponding to temperature in the rotor chamber 3.

Figure 12:
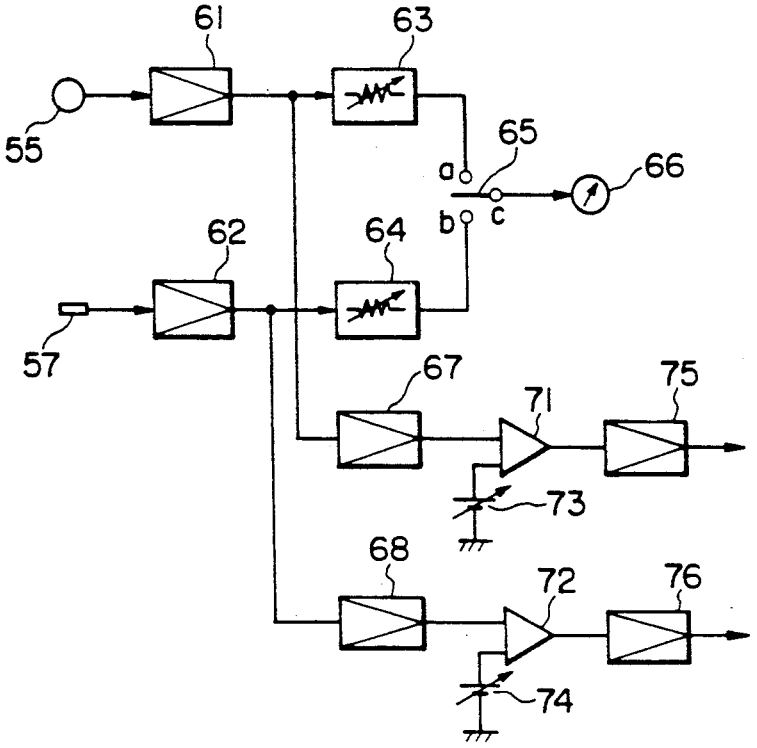
FIG. 12 is a block diagram showing the connections of a rotary sensor and a temperature sensor to an indicator.

As illustrated in FIG. 12, the electric signal outputs from the rotary sensor 55 and the temperature sensor 57 are amplified by amplifiers 61 and 62, as required, and are level adjusted by level adjusters 63 and 64, thereafter being applied to fixed contacts a and b of a change-over switch 65. The output at a movable contact c of the change-over switch 65 is provided to an indicator 66.

The outputs from the amplifiers 61 and 62 are branched and further amplified by amplifiers 67 and 68. The amplified outputs are applied to comparators 71 and 72, respectively, wherein they are compared with voltages generated by a set rotational frequency voltage generator 73 and a set temperature voltage generator 74, respectively, and the difference voltages are amplified by amplifiers 75 and 76, providing a rotational frequency control output and a freezing machine control output.

Figure 13:
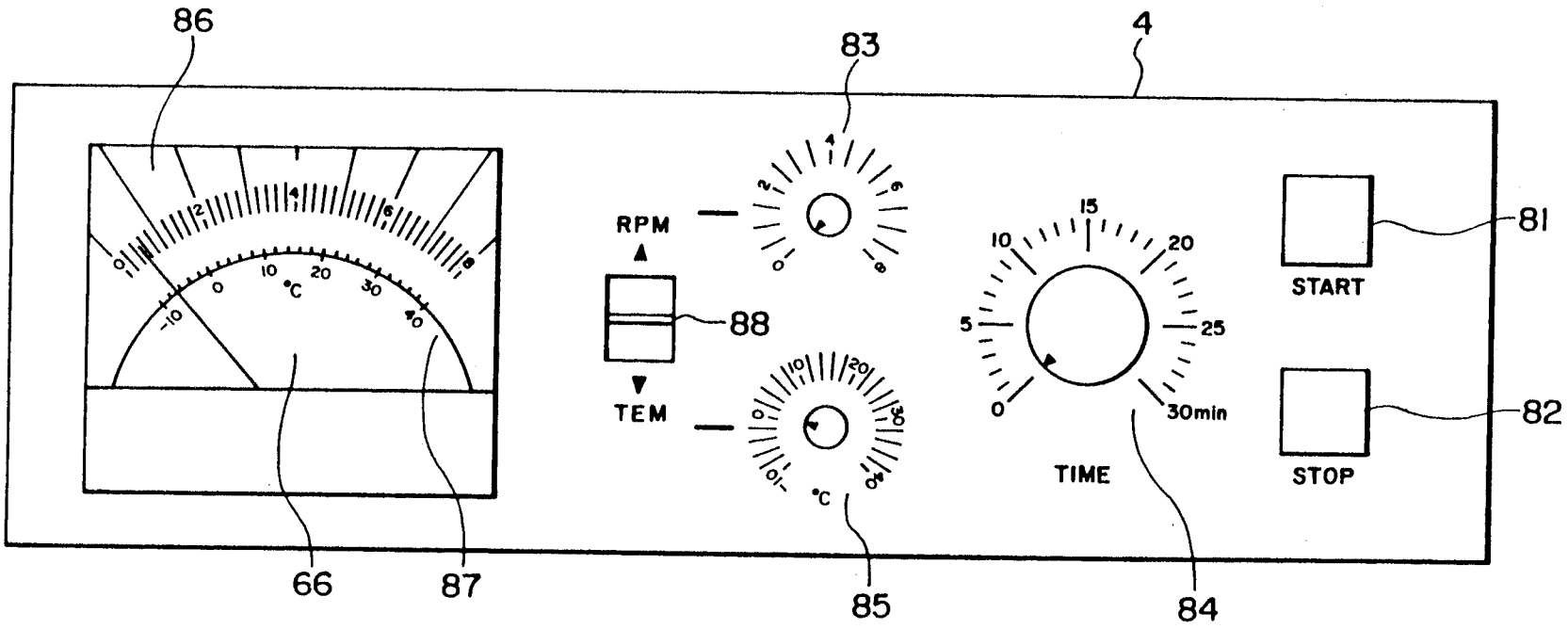
FIG. 13 is a front view showing an example of a control panel 4.

On the control panel 4 there are provided a start button 81, a stop button 82, a rotor speed setting section 83, a rotor driving time setting section 84, a rotor chamber temperature setting section 85 and a common indicator 66, as shown in FIG. 13. On the indicator 66 a rotational frequency scale 86 and a temperature scale 87 are provided as a double scale. By manipulating a knob 88 of the change-over switch 65, by moving it up in this example, the movable contact c of the change-over switch 65 is connected to the fixed contact a, through which the output of the rotary sensor 55 is supplied to the indicator 66, to indicate the rotational frequency of the rotor 8. When moving down the knob 88, the movable contact c of the change-over switch 65 is connected to the fixed contact b, through which the output of the temperature sensor 57 is applied to the indicator 66, indicating thereon the temperature of the rotor chamber 3.

The level adjuster 63 is regulated so that during the supply of the output of the rotary sensor 55 to the indicator 66 the rotational frequency of the rotor 8 at that time may agree with the indication on the indicator 66. The level adjuster 64 is similarly regulated for the output of the temperature sensor 57.

As described above, according to the present invention, the rotational frequency of the rotor and the temperature of the rotor chamber can be indicated on the same indicator and the control panel 4 can be reduced in size correspondingly. This makes it possible to provide the control panel 4 corresponding to the cutaway 11 of the panel 5 as shown in FIG. 3, and hence permits reduction of the whole size of the centrifugal separator. Moreover the control panel 4 will not be hidden by the lid 5 when the latter is open.

In general, the rotational frequency of the rotor must be monitored relatively frequently, but the temperature of the rotor chamber hardly undergoes abrupt changes, and hence needs only to be monitored as required. In other words, it is preferable that the change-over switch be normally held at the position for applying the output of the rotary sensor to the indicator and, as required, to shift it to the position for indicating the temperature of the rotor chamber.

It will be apparent that many modifications and variations may be effected without departing from the scope of the novel concepts of the present invention.

What is claimed is:

1. A centrifugal separator comprising:

a case which has a top panel that includes an opening to a rotor chamber within said case;

an upstanding control panel provided adjacent a rear marginal side of said top panel to the rear of said opening; and a lid pivotally mounted on said case for closing said opening, said lid having a rear edge which is hingedly connected to said case adjacent said rear marginal side of said top panel and adjacent the rear side of said upstanding control panel for pivotal movement of said lid between open and closed positions relative to said opening, and said lid having a cutaway in its said rear edge through which said upstanding control panel passes when said lid is pivotally moved between its said open and closed positions, said control panel extending above said top panel and protruding above said lid through said cutaway when said lid is in its closed position.

2. The centrifugal separator of claim 1, wherein the depth d of the cutaway is larger than the height h and the front-to-back width w of the control panel.

3. The centrifugal separator of claim 1 wherein said opening is substantially circular except for its rear edge, the rear edge of said opening being substantially linear and extending in a direction substantially parallel to said rear edge of said top panel.

4. The centrifugal separator of claim 1 further including a lid lock mechanism disposed in said case, said mechanism having lock means adapted to engage with and disengage from a hook on said lid in response to a lateral motion of an operating plate disposed in said case; a pedal disposed adjacent the bottom of the case; a transmission mechanism coupled to the pedal for transmitting a vertical motion of said pedal to said operating plate; a motion changing mechanism provided between said transmission mechanism and said operating plate for changing a vertical motion of said pedal to lateral motion of said operating plate; and biasing means for biasing said lid toward its open position to open said lid when said lock means are disengaged from said hook.

5. A centrifugal separator comprising:

a case which has a top panel that includes an opening to a rotor chamber within said case;

a control panel provided adjacent a rear marginal side of said top panel to the rear of said opening; and a lid pivotally mounted on said case for closing said opening, said lid having a rear edge which is hingedly connected to said case adjacent said rear marginal side of said top panel for pivotal movement of said lid between open and closed positions relative to said opening, and said lid having a cutaway in its said rear edge through which said control panel passes when said lid is pivotally moved between its said open and closed positions, whereby said control panel protrudes above said lid through said cutaway when said lid is in its closed position, said centrifugal separator further including a rotary sensor for generating an electric signal corresponding to the rotational frequency of a rotor in said rotor chamber; a temperature sensor disposed in said rotor chamber for providing a further electric signal corresponding to the temperature of the rotor chamber; an indicator on said control panel for selectively indicating the rotational frequency of the rotor and the temperature in said rotor chamber; a change-over switch disposed on said control panel and connected between said indicator and said sensors for supplying a selected one of said electric signals to said indicator; and a level adjuster connected between said change-over switch and at least one of said sensors for adjusting the level of the electric signal to be supplied to said indicator.

6. The centrifugal separator of claim 5 further including a lid lock mechanism disposed in said case, said mechanism having lock means adapted to engage with and disengage from a hook on said lid in response to a lateral motion of an operating plate disposed in said case; a pedal disposed adjacent the bottom of said case at the front side of the case; a transmission mechanism coupled to the pedal for transmitting a vertical motion of said pedal to said operating plate; a motion changing mechanism provided between said transmission mechanism and said operating plate for changing a vertical motion of said pedal to a lateral motion of said operating plate; and biasing means for biasing said lid toward its open position.

7. A centrifugal separator comprising:

a case which has a top panel that includes an opening to a rotor chamber within said case;

a lid pivotally mounted on said case for closing said opening;

a lid lock mechanism disposed in said case for engaging and disengaging lock means with and from a hook on said lid in response to a lateral motion of an operating plate in said case;

a pedal disposed adjacent the bottom of said case;

a transmission mechanism coupled to said pedal for transmitting a vertical motion of said pedal to said operating plate;

a motion changing mechanism disposed between said transmission mechanism and said operating plate, for changing the vertical motion of said pedal to the lateral motion of said operating plate; and biasing means between said case and said lid for biasing said lid toward its open position to open the lid when said lock means are disengaged from said hook;

said lid lock mechanism comprising:

a base plate disposed in said case in opposing relation to a front panel of said case;

a pair of lock plates mounted on said base plate, said lock plates being rotatable about a common shaft in a plane parallel to said front panel of the case, each of said lock plates having said lock means protruding thereof in a direction perpendicular to said plane for engagement with said hook;

a spring coupled between said pair of lock plates for biasing said lock means toward one another to hold said hook between said lock means;

said operating plate being mounted on said base plate for lateral movement relative thereto, and said operating plate being coupled to said pair of lock plates to cause rotational movements of said pair of lock plates about said common shaft in opposite directions relative to one another so that said lock means are disengaged from said hook by a lateral motion of said operating plate in one direction against the biasing force of said spring.

8. The centrifugal separator of claim 6 or 7 wherein said transmission mechanism is a wire connected at one end thereof to said pedal and connected at the other end thereof to said motion changing mechanism.

9. The centrifugal separator of claim 6 or 7 wherein said motion changing mechanism comprises a pair of pulleys spaced from one another, and a wire passing over said pulleys and connected at one end to said transmission mechanism and at the other end to said operating plate.

10. The centrifugal separator of claim 9, wherein one of said pulleys is adjustable in position.

11. The centrifugal separator of claim 6 or 7 wherein said operating plate is biased in a direction which locks said lid lock mechanism, and a stopper is provided on said transmission mechanism for preventing said pedal from rising beyond a predetermined position.

12. The centrifugal separator of claim 6 or 7, wherein the transmission mechanism includes a coiled spring.

* * * * *